US009934900B2

(12) United States Patent
Bichler

(10) Patent No.: US 9,934,900 B2
(45) Date of Patent: Apr. 3, 2018

(54) ELECTRONIC COMPONENT FOR GUIDING A MAGNETIC FIELD

(71) Applicant: EPCOS AG, München (DE)

(72) Inventor: Martin Bichler, Walchstadt (DE)

(73) Assignee: EPCOS AG, Munich (DE)

( * ) Notice: Subject to any disclaimer, the term of this patent is extended or adjusted under 35 U.S.C. 154(b) by 0 days.

(21) Appl. No.: 14/354,127

(22) PCT Filed: Oct. 22, 2012

(86) PCT No.: PCT/EP2012/070881
§ 371 (c)(1),
(2) Date: Apr. 24, 2014

(87) PCT Pub. No.: WO2013/060649
PCT Pub. Date: May 2, 2013

(65) Prior Publication Data

US 2014/0266537 A1 Sep. 18, 2014

(30) Foreign Application Priority Data

Oct. 25, 2011 (DE) ..... 10 2011 116 861

(51) Int. Cl.
*H01F 17/06* (2006.01)
*H01F 27/24* (2006.01)
(Continued)

(52) U.S. Cl.
CPC ..... *H01F 27/24* (2013.01); *H01F 3/14* (2013.01); *H01F 27/263* (2013.01); *H01F 27/33* (2013.01); *H01F 41/02* (2013.01); *Y10T 29/4902* (2015.01)

(58) Field of Classification Search
CPC ..... H01F 27/24; H01F 27/33; H01F 27/263; H01F 27/26; H01F 41/02; H01F 3/14; Y10T 29/4902
(Continued)

(56) References Cited

U.S. PATENT DOCUMENTS 2,660,640 A * 11/1953 Wolf ..... H01C 10/103 192/21.5
2,728,054 A 12/1955 Albers-Schoenberg
(Continued)

FOREIGN PATENT DOCUMENTS

DE 2836401 A1 2/1980
DE 2933781 A1 3/1981
(Continued)

OTHER PUBLICATIONS

"Audio Noise Suppression Techniques", Application Note AN-24, Sep. 1999, pp. 1-12.

*Primary Examiner* — Mangtin Lian
(74) *Attorney, Agent, or Firm* — McDermott Will & Emery LLP

(57) ABSTRACT

An electronic component for guiding a magnetic field comprises a core (20) of a magnetizable material, which has at least two spaced-apart legs (11*a*, 11*b*) with opposing surfaces (O11*a*, O11*b*) separated from one another by a gap (S). The component comprises at least one compressible molding (20), which is arranged compressed in the gap (S), the at least one molding (20) being in contact with the respective surfaces (O11*a*, O11*b*) of the at least two spaced-apart legs (11*a*, 11*b*).

5 Claims, 5 Drawing Sheets

Figure 1A:
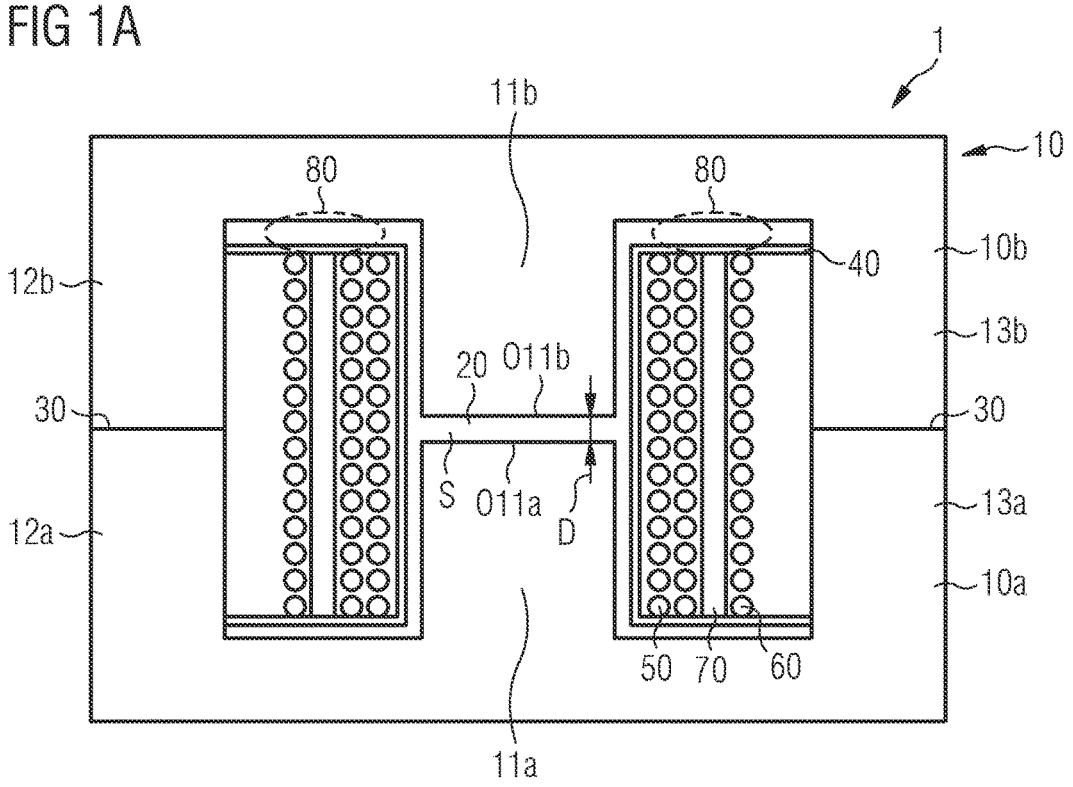

(51) Int. Cl.

| | |
|---|---|
| ***H01F 27/30*** | (2006.01) |
| ***H01F 3/14*** | (2006.01) |
| ***H01F 27/26*** | (2006.01) |
| ***H01F 27/33*** | (2006.01) |
| ***H01F 41/02*** | (2006.01) |

(58) Field of Classification Search
USPC ..... 336/178, 212, 184, 198, 208; 29/602.1
See application file for complete search history.

(56) References Cited

U.S. PATENT DOCUMENTS

| | | | | |
|---|---|---|---|---|
| 3,665,288 | A * | 5/1972 | Godawski | H01F 38/42 315/405 |
| 5,025,241 | A * | 6/1991 | Bouillot et al. | 336/100 |
| 5,378,966 | A | 1/1995 | Marszalik | |
| 5,656,983 | A | 8/1997 | Ito et al. | |
| 5,926,946 | A | 7/1999 | Minato et al. | |
| 6,177,855 | B1 * | 1/2001 | Bouillot et al. | 336/178 |
| 8,598,973 | B2 * | 12/2013 | Kawaguchi | H01F 3/14 336/199 |
| 2011/0309905 | A1 * | 12/2011 | Anger et al. | 336/212 |
| 2012/0044033 | A1 * | 2/2012 | Kawaguchi | H01F 3/14 336/90 |

FOREIGN PATENT DOCUMENTS

| | | | | |
|---|---|---|---|---|
| DE | 3412003 | A1 | | 10/1985 |
| DE | 8609584 | U1 | | 8/1987 |
| DE | 3611906 | A | * | 10/1987 |
| DE | 3611906 | A1 | | 10/1987 |
| DE | 3732965 | A1 | | 4/1989 |
| DE | 3881158 | T2 | | 11/1993 |
| DE | 69008226 | T2 | | 8/1994 |
| DE | 4307471 | A1 | | 9/1994 |
| DE | 69430471 | T2 | | 1/2003 |
| DE | 102006005243 | A1 | | 8/2006 |
| DE | 202009003806 | U1 | | 6/2009 |
| GB | 2039156 | A | | 7/1980 |
| JP | S5316863 | | | 2/1978 |
| JP | S5726833 | | | 2/1982 |
| JP | H02281720 | A | | 11/1990 |
| JP | H06151190 | A | | 5/1994 |
| JP | H07230918 | A | | 8/1995 |
| JP | H0851032 | A | | 2/1996 |
| JP | H09102430 | A | | 4/1997 |
| JP | 2004235462 | A | | 8/2004 |
| JP | 2006310589 | A | | 11/2006 |
| JP | 2007335523 | A | | 12/2007 |
| JP | 2009272446 | A | | 11/2009 |
| JP | 2010171124 | A | | 8/2010 |
| JP | 2010171312 | A | | 8/2010 |
| JP | 2011066242 | A | | 3/2011 |
| WO | WO2010/128648 | | * | 11/2010 |

* cited by examiner

ELECTRONIC COMPONENT FOR GUIDING A MAGNETIC FIELD

The invention relates to an electronic component for guiding a magnetic field, which can be used in particular as an inductor or a transformer. The invention also relates to a method for producing an electronic component for guiding a magnetic field, in particular a component that can be used as an inductor or a transformer.

In switching network parts or voltage supply devices for lamps, clocked semiconductor circuits with inductors or transformers may be used. Inductive electronic components in which a magnetic field is generated and guided in a core may for example take the form of such inductors or transformers. One of the ways in which the electrical and magnetic properties of these inductive components are set is by way of an air gap in the ferromagnetic core. The presence of the air gap causes an acoustically audible and disturbing humming noise to be produced when inductors or transformers are activated by low frequencies or frequency packets. The noise is produced by the alternating magnetization and the associated mechanical movement of the legs of the core.

It is desirable to provide an electronic component for guiding a magnetic field in which the production of noises when the component is activated by a signal is largely reduced. Furthermore, it is intended to provide a method for producing an electronic component for guiding a magnetic field in which the occurrence of humming noises when the component is activated by a signal is suppressed to the greatest extent.

An embodiment of an electronic component for guiding a magnetic field comprises a core of a magnetizable material, which has at least two spaced-apart legs with opposing surfaces separated from one another by a gap. The component also comprises at least one compressible molding, which is arranged compressed in the gap, the at least one molding being in contact with the respective surfaces of the at least two spaced-apart legs.

An embodiment of a method for producing an electronic component for guiding a magnetic field comprises the provision of a material web of a compressible material. At least one molding is separated from the material web. The component, which comprises the at least one molding and a magnetizable core, the core having at least two spaced-apart legs with opposing surfaces separated from one another by a gap, is provided by the production method by the at least one molding being compressed between the respective surfaces of the legs and being in contact with the respective surfaces of the legs.

In the case of the electronic component for guiding a magnetic field, one or more prefabricated moldings are arranged in the air gap between the legs of the core. The moldings may for example be cut out or punched out from a prefabricated material web. The material web may for example include silicone or acrylic or polyurethane. Such a prefabricated material web is gel- or elastomer-like and may be slightly tacky, and consequently take a self-adhesive form.

The prefabricated material web may furthermore be of an extremely compressible form. It may for example have a Shore A hardness of 10 to 60, and preferably of 20 to 40. Since the molding is consequently arranged compressed in the air gap between the opposing surfaces of the spaced-apart legs, the material web may have a thickness that is greater than the air gap to be filled between the legs of the core.

The prefabricated material web may be formed as a flat mat, from which the moldings are separated. As an alternative to this, the prefabricated material web may be wound up on a drum, from which the moldings for filling the air gap are cut out with appropriate shapes.

The aforementioned base materials of the prefabricated material webs may be filled with fillers. Natural fillers, such as stone, sand or quartz, or industrial fillers, for example glass, ceramic or glass-ceramic, or organic fillers may be used for this. By admixing such fillers with the base material, the thermal expansion of the molding can be adapted to the thermal expansion of the other parts of the component, for example to the thermal expansion of the core or a coil former of a coil arranged on the legs. Furthermore, appropriate selection of the fillers allows better energy conversion of the mechanical movement of the legs during the activation by an electronic signal to be achieved, and consequently more effective noise damping to be achieved.

The use of prefabricated material webs of compressible self-adhesive material, from which the molding for filling the air gap between the legs is separated, makes it possible for example to dispense with the use of adhesives in the air gap. The use of the self-adhesive, prefabricated moldings in the air gap consequently does not require any further process step, such as for example the curing of an adhesive.

Moldings with any desired outline can be cut out from the prefabricated material webs. The moldings may for example be separated from a material web in such a way that the outline of a molding corresponds to the outline of the surfaces of the legs between which the molding is arranged. The moldings may be cut out from the material webs in such a way that they can be adapted in their form, both individually and in combination, to the air gap to be filled.

The simple shaping allows critical processes that may occur for example in the metering or curing of an adhesive between the legs to be avoided. When they are introduced into the air gap, the moldings are already in the hardened state, so that the entire fabrication process can be carried out reproducibly, reliably and by machine. The use of the prefabricated, self-adhesive material webs and the moldings cut out from them allows both a production process performed by machine and a production process performed manually to be further optimized.

As a result of the compressible property of the material web, the moldings cut out from it can be used universally for differently formed air gaps of inductors or transformers, so that the storing of a large number of differently formed individual parts or of spacers that correspond in their component height to the different gap spacings does not appear to be necessary, whereby storage costs can be reduced and adequate availability can be ensured.

Irrespective of the implementation of an adhesive process, a final fabrication check can be realized in an uncomplicated form by appropriate activation of the electronic component. In this check, the electronic component is activated by a suitable signal that would cause a humming noise when the air gap is not filled. Only the occurrence or non-occurrence of the noise is monitored. If a noise occurs, the absence of the molding in the air gap can be deduced.

The invention is explained in more detail below on the basis of figures, which show exemplary embodiments of an electronic component for guiding a magnetic field and of a method for producing such an electronic component.

Figure 1B:
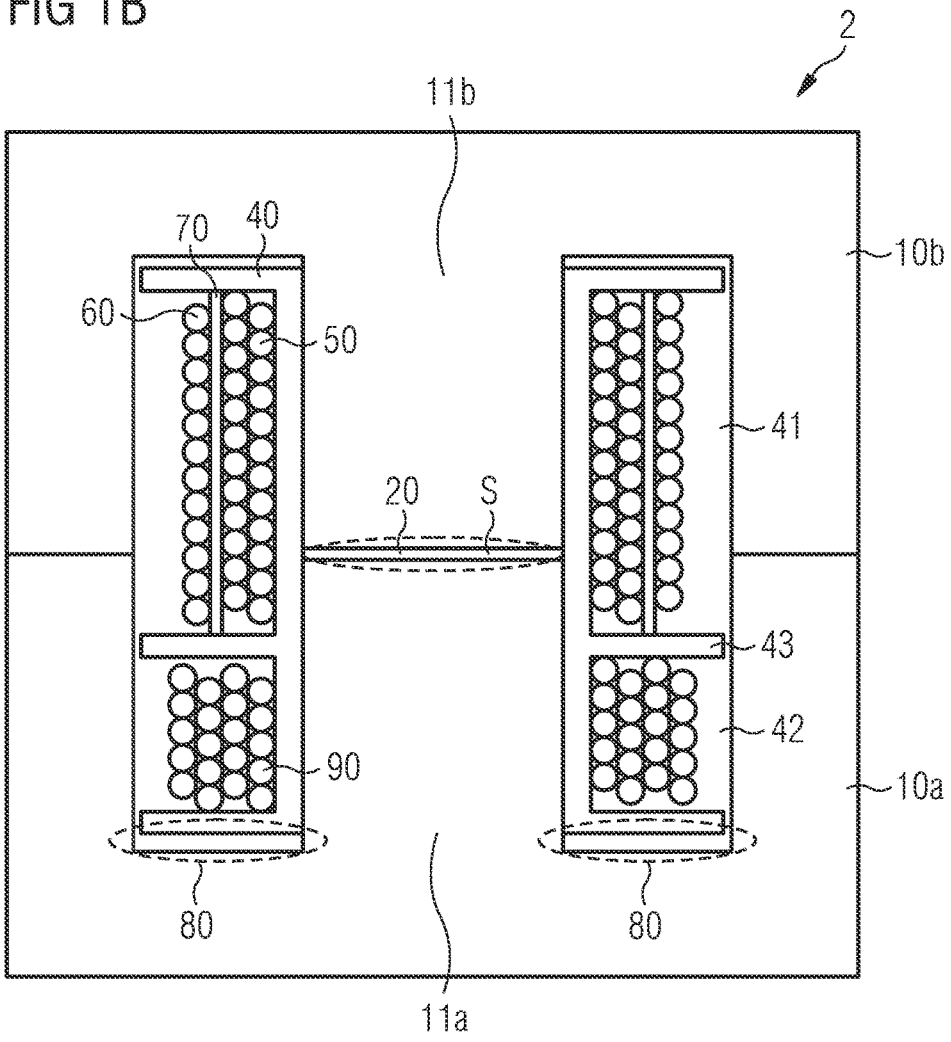
Figure 2:
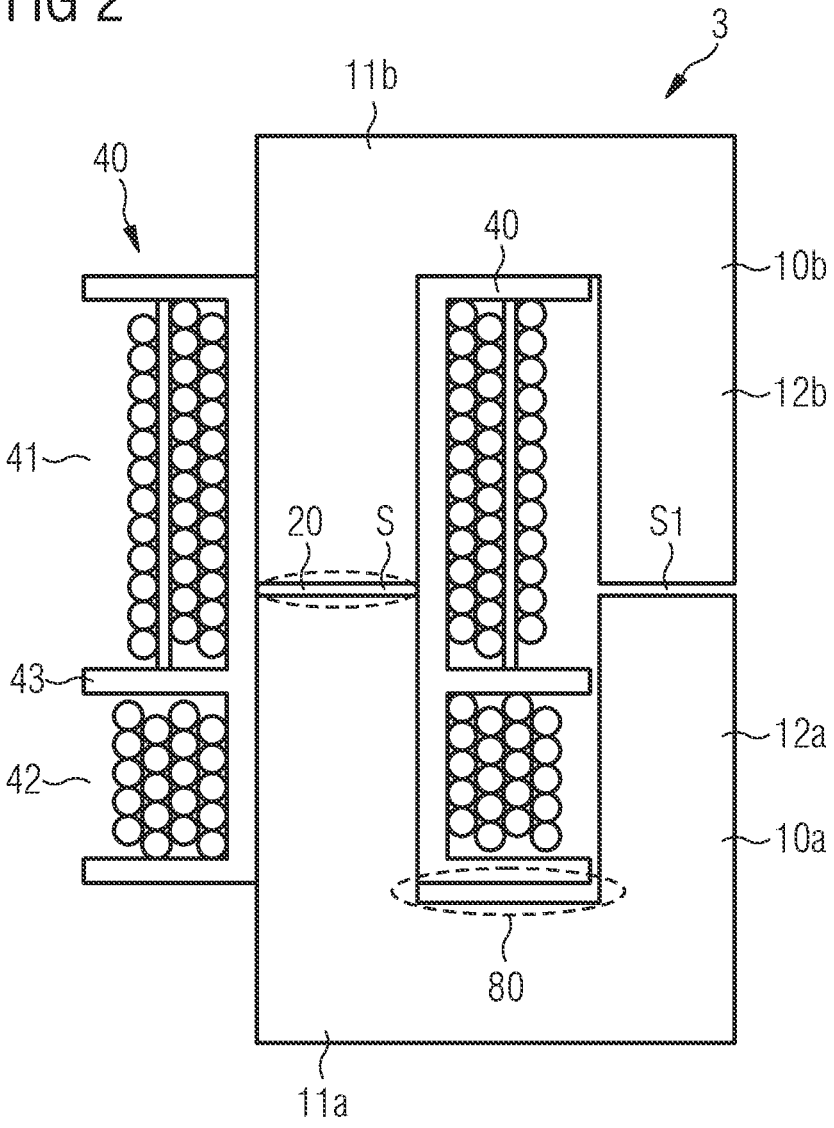
Figure 3:
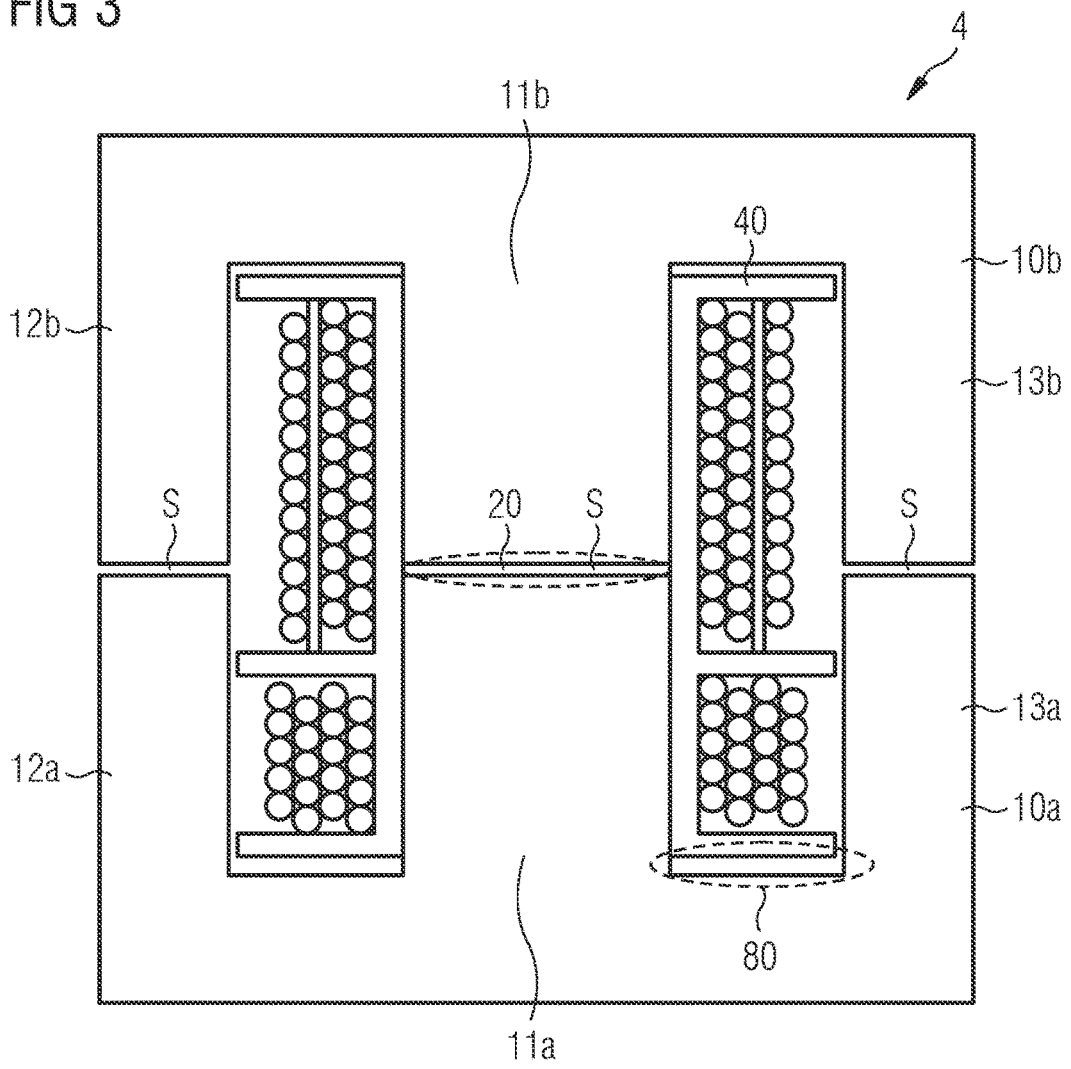
Figure 4A:
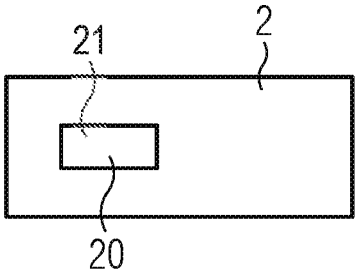
Figure 4B:
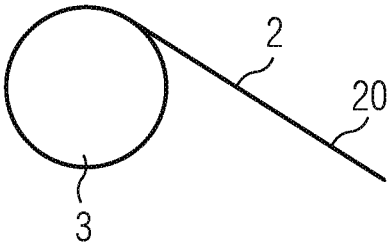

In the figures:

FIG. 1A shows an embodiment of an electronic component for guiding a magnetic field, FIG. 1B shows a further embodiment of an electronic component for guiding a magnetic field, FIG. 2 shows a further embodiment of an electronic component for guiding a magnetic field, FIG. 3 shows a further embodiment of an electronic component for guiding a magnetic field, FIG. 4A shows a prefabricated material web with a molding cut out from the material web, FIG. 4B shows a prefabricated material web wound up on a drum.

FIG. 1A shows an embodiment of an electronic component 1 for guiding a magnetic field within a core 10. The component may be formed for example as a transformer or an inductor. The core may be formed as an E core, which comprises a part-body 10*a* and a part-body 10*b*. The part-body 10*a* has a central leg 11*a* and lateral legs 12*a*, 13*a*. The part-body 10*b* takes the same form as the part-body 10*a* and comprises a central leg 11*b*, as well as lateral legs 12*b* and 13*b*. The part-bodies may include a material from iron oxide, manganese oxide, zinc oxide or ceramic substances.

The two part-bodies 10*a* and 10*b* are arranged one on top of the other. The legs of the part-bodies are formed in such a way that the legs 12*a*, 13*a* and 12*b*, 13*b* are in contact at their end faces. The two central legs 11*a* and 11*b* are arranged spaced apart from one another and have opposing surfaces O11*a*, O11*b*, which are separated from one another by a gap S or a spacing D. For fixing the two part-bodies, the lateral legs may be fixed to one another by an adhesive 30. The two part-bodies may also be held together by an outer clip device.

In the case of the exemplary embodiment of the electronic component that is shown in FIG. 1A, a wire winding is arranged on a coil former 40. If the inductive component is formed as a transformer or an inductor, the wire winding may for example comprise a primary winding 50 and a secondary winding 60, which are separated from one another by an insulator 70, for example an insulating strip of polyester. This allows a short-circuit between the primary winding and the secondary winding to be avoided. An enameled wire may be used for the two wire windings 50 and 60. The wire includes a conductive material, for example a material of copper, which is surrounded by an insulating layer, for example an enamel layer.

For reasons of the stray magnetic field, the air gap usually lies between the central legs of the core, which are spatially enclosed by the coil former 40. In the case of the embodiment of the electronic component that is shown in FIG. 1, the coil former 40 is arranged partly on the leg 11*a* of the part-body 10*a* and partly on the leg 11*b* of the part-body 10*b*. The coil former may be fixed to the lower part-body 10*a* of the core between the lateral legs 12*a* and 13*a* and the central leg 11*a* by an adhesive component 80. Correspondingly, the coil former 40 may be fastened to the upper part-body 10*b* between the lateral legs 12*b*, 13*b* and the central leg 11*b* by the adhesive component 80.

Apart from the embodiment shown in FIG. 1A, configurations of the electronic component in which the coil former is arranged on the lateral legs 12*a*, 12*b* or 13*a*, 13*b* are possible. Furthermore, apart from the arrangement of the wire winding that is shown in FIG. 1A, in which the wires 50 and 60 are arranged one over the other in the horizontal direction, an arrangement in which the wires 50 and 60 are arranged on the coil former one over the other in the vertical direction may be used.

FIG. 1B shows an embodiment of an electronic component 2 with an E core with part-bodies 10*a* and 10*b*, which, like the E core shown in FIG. 1A, is formed with an air gap S between the central legs 11*a* and 11*b*. The coil former 40 has a chamber-shaped region 41, in which a primary winding 50 and a secondary winding 60, which are electrically separated from one another by an insulating strip 70, are arranged. In a second chamber-shaped region 42 of the coil former 40, arranged under the first region, only one wire winding is arranged. The first and second regions are separated by a cross-piece 43 of the coil former, which is arranged between the first and second regions. Between the coil former 40 and the lower part-body 10*a* of the core there may be arranged an adhesive component 80, by which the coil former is fixed to the part-body 10*a* of the core.

FIG. 2 shows a further embodiment of an electronic component 3. As in the case of the embodiment 2, the coil former is configured with a chamber 41 and a chamber 42. Instead of an E core, the component has a U core, comprising a part-body 10*a* and a part-body 10*b*. The part-body 10*a* has the legs 11*a* and 12*a* and the part-body 10*b* has the legs 11*b* and 12*b*. Respectively arranged between the legs is an air gap S. The two part-bodies may also be held together by a clip. The coil former 40 is arranged on the legs 11*a* and 11*b* and is fixed to the part-body 10*a* in a region of the part-body 10*a* between the legs 11*a* and 12*a* by an adhesive component 80.

FIG. 3 shows a further embodiment of an electronic component 4 with an E core and a number of air gaps S. One of the air gaps is arranged between the central lugs 11*a* and 11*b*. Further air gaps are arranged between the outer legs 12*a* and 12*b*, and respectively 13*a* and 13*b*. The coil former is formed in the same way as in the case of the embodiments 2 and 3 of the electronic component and arranged on the central lug. For fixing to the E core, the coil former 40 may be fixed to the part-body 10*a* in a region between the legs 11*a* and 13*a* for example by the adhesive component 80. The two part-bodies may be held together by an outwardly attached clip device that is not represented.

Transformers may be used both for guiding a magnetic flux and for realizing coupled coils in an isolating transformer. In the case of this use, energy is buffer-stored in the air gap and removed at a later time.

In one possible way in which the inductive component is operated, an alternating voltage may for example be applied to the primary winding 50 as an input voltage and a transformed output voltage picked off at the secondary winding 60. The alternating voltage leads to an alternating magnetization, and consequently to mechanical movement of the core legs of the inductor or transformer. A disturbing humming noise then occurs in particular at the air gap between the spaced-apart legs 11*a* and 11*b*.

In order to dampen the movement of the legs, in particular the central legs 11*a* and 11*b*, the legs may be adhesively bonded to one another. In this case, an adhesive may be introduced in the air gap between the legs 11*a* and 11*b*. In addition, hard materials that can prevent noise from being produced, of a thickness corresponding to that of the air gap, may be inserted between the legs 11*a* and 11*b*.

In the case of another embodiment, in the gap S, a compressible molding 20 is arranged compressed between the end faces O11*a*, O11*b* of the two legs 11*a* and 11*b*. In the non-compressed state, the molding 20 has a thickness or material thickness that is greater than the spacing D between the opposing surfaces O11*a*, O11*b* of the two central legs. The molding 20 may be arranged compressed in the gap S between the two legs 11*a* and 11*b* in such a way that the entire gap is filled by the molding. The compressed molding can consequently be in contact with the entire surfaces O11*a*, O11*b* of the legs 11*a*, 11*b*. Depending on the outer contour or the material thickness of the molding, the molding 20 may for example also merely be in contact with part of the surfaces O11*a*, O11*b*.

In order that the molding can be arranged compressed between the end faces of the legs, the molding may be of an extremely compressible form and for example comprise a material with a Shore A hardness of 10 to 60, and preferably of 20 to 40. In comparison with its non-compressed state, the molding may be compressed to 20% to 40% of its original thickness when it is introduced into the gap S. The molding comprises a material which is compressed onto a surface of the molding in the decompressed state when a pressure is exerted and resumes the original decompressed state when the pressure is relieved.

The air gap S may for example have a spacing D between the end faces O11*a*, O11*b* of the two central legs 11*a*, 11*b* of between 0.1 mm and 1.2 mm. If the air gap has for example a spacing of 1 mm, a molding 20 may have in the uncompressed state a thickness of 1.25 mm to 1.5 mm. When the two part-bodies 10*a* and 10*b* are arranged one on top of the other, the molding 20 may be compressed to a thickness of 1 mm.

The molding may include a material from silicone, acrylic or polyurethane. On account of the mentioned base materials of the molding, the surface of the molding is slightly tacky, so that the molding 20 may be arranged in a self-adhesive manner on the surfaces O11*a* and O11*b* of the opposing legs. A molding that is not self-adhesive may also be used.

The base material of the molding may have fillers. The base material may for example have natural fillers, which include stone, sand or quartz. The base material may also have organic fillers or industrial fillers, such as for example glass, ceramic or glass-ceramic. Furthermore, silicon compounds, for example silica, may be used as fillers. By means of the fillers, the thermal expansion of the molding 20 can be adapted to the other parts of the component, for example to the thermal expansion of the core 10 or of the coil former. Furthermore, the fillers make an energy conversion of the mechanical movement possible, in that the mechanical energy that occurs during the movement of the core legs can be absorbed by the molding 20, so that the development of noise is suppressed.

If the molding of the base material with or without filler is mechanically unstable, the molding may additionally have a carrier material 21. The carrier material 21 has a greater strength and a greater material resistance than the base material. The carrier material 21 may for example be a glass-fiber mat that is coated with the base material.

The molding 20 may be cut out from a prefabricated material web. FIG. 4A shows for example the material web 2 in the form of a mat. According to the embodiment shown in FIG. 4B, the material web 2 may also be wound up on a drum 3. The moldings 20 may be separated or detached from the material web 2, for example cut out or punched out. Consequently, the moldings may be prefabricated with respect to their later use on the inductive component. Any desired moldings 20, which may be designed in their form, both individually and in combination, such that they are optimally adapted to the air gap S to be filled of the component in which they are later used, can be cut out from the material web 2. The moldings 20 may for example be cut out from the material web 2 in such a way that the outline of a surface O20 of the molding 20 corresponds to the outline of the surface O11*a*, O11*b* of the legs 11*a*, 11*b*. The moldings may have a surface O20 that corresponds to the surface O11*a*, O11*b* both in the compressed state and in the non-compressed state. The moldings may also have a surface that is different from the surface O11*a*, O11*b*.

As a difference from the introduction of an adhesive between the legs of a finished component, the material web is already pre-produced before the actual production of the inductive component. The material web may comprise a base material, which may include silicone, polyurethane or acrylic. On account of the mentioned materials, the material web 2 may be formed in a gel- or elastomer-like manner and is slightly tacky on its surface, and consequently takes a self-adhesive form. Depending on the materials of the component in which the moldings are later used, fillers, for example the aforementioned materials, may be mixed in with the base material, so that for example the thermal expansion of the molding can be adapted to the greatest extent to the thermal expansion of the materials of the component. This allows a material web with material properties adapted to the later use to be prefabricated.

Whereas, in the case of the use of adhesives that are introduced into the air gap between the legs, the metering of the correct amount and the correct position of the adhesive in the gap represent a considerable problem, and can only be kept under control with great effort, the use of a prefabricated molding for filling the air gap makes a simplified fabrication process and increased reliability possible, while at the same time minimizing noise. The moldings are pre-produced with respect to the production of an inductive component, for example a coil or an inductor, and may be provided in final and prefabricated forms.

For the production of an inductive component, for example a transformer or an inductor, the prefabricated moldings 20 may for example be designed in the fabrication of the core for the surface O11*a* of the leg 11*a*. On account of the self-adhesive property, the molding 20 may in this case already be sufficiently fixed on the surface O11*a* of the leg 11*a*, so that the use of additional adhesive is not necessary.

For the production of the wire coil comprising a primary coil and a secondary coil, the coil former 40 is first wound with the wire winding 50. The insulating strip 70 is arranged on the wire winding 50. The wire winding 60 is wound around the insulating strip 70. The coil former wound in this way can be placed onto the leg 11*a*, so that the leg 11*a* is arranged in a hollow body of the coil former on which the wires 50 and 60 are wound up.

For the further production of the core 10, the part-body 10*b* may be placed onto the part-body 10*a*. In this case, the lateral legs 12*a*, 12*b* and 13*a*, 13*b* may be adhesively bonded to one another by an adhesive 30. The leg 11*b* runs through the hollow body of the coil former. The core halves are formed in such a way that the facing surfaces O11*a* and O11*b* of the opposing legs 11*a* and 11*b* have a spacing D that is smaller than the thickness of the molding 20. On account of the compressible material of the molding, the molding is consequently compressed between the surfaces O11*a* and O11*b* of the legs 11*a* and 11*b*. The entire gap S may in this case be filled by the molding 20.

If the molding is produced from slightly tacky base materials, for example from silicone, silica compounds, acrylic or polyurethane, the molding 20 is then fixed in a self-adhesive manner between the legs 11*a* and 11*b*. Further process steps, such as for example the curing of an adhesive, are not required.

LIST OF DESIGNATIONS

1 Electronic component
2 Material web/mat

3 Drum
10 Core
10*a*, 10*b* Part-body
12*a*, 12*b*, 13*a*, 13*b* Lateral legs
11*a*, 11*b* Central legs
20 Molding
30 Adhesive
40 Coil former
50, 60 Wire winding
70 Insulating strip
80 Adhesive component

The invention claimed is:

1. An electronic component for guiding a magnetic field, comprising:

a core (10) of a magnetizable material, which has at least two spaced-apart legs (11*a*, 11*b*) with opposing surfaces (O11*a*, O11*b*) separated from one another by a gap (S); and at least one compressible and prefabricated molding (20), being cut out from a material web, which is arranged compressed in the gap (S), the at least one molding (20) being in contact with the respective surfaces (O11*a*, O11*b*) of the at least two spaced-apart legs (11*a*, 11*b*), wherein the surface of the molding (20) is tacky and the molding (20) is arranged in a self-adhesive manner on the respective surfaces (O11*a*, O11*b*) of the at least two spaced-apart legs (11*a*, 11*b*), wherein the at least one molding (20) has a thickness in the non-compressed state that is greater than a spacing (D) between the respective surfaces (O11*a*, O11*b*) of the at least two spaced-apart legs (11*a*, 11*b*), wherein the at least one molding (20) includes a base material from silicone, acrylic or polyurethane and a filler material mixed in with the base material, wherein the filler material comprises stone, sand or quartz, wherein by admixing the filler material with the base material, the thermal expansion of the at least one molding (20) is adapted to the thermal expansion of other parts of the electronic component, and wherein the filler material has a configuration which provides for energy conversion of a mechanical movement of the legs (11*a*, 11*b*) and for noise damping during the activation of the electronic component by an electronic signal.

2. The electronic component according to claim 1, the molding (20) including a carrier material, which has a greater strength than the base material, the base material being arranged on the carrier material.

3. The electronic component according to claim 1, the filler material further comprising at least one of an industrial filler, an organic filler, or a silicon compound.

4. The electronic component according to claim 3, comprising:

a coil former (40) with a wire winding (50, 60);

the core (10) having at least two legs (12*a*, 13*a*, 12*b*, 13*b*) that are in contact at their end faces, the core (10) comprising a first part-body (10*a*), which has the leg (11*a*) of the at least two spaced-apart legs and the leg (12*a*, 13*a*) of the at least two in-contact legs, and a second part-body (10*b*), which has the other leg (11*b*) of the at least two spaced-apart legs and the other leg (12*b*, 13*b*) of the at least two in-contact legs, the second part-body (10*a*) being arranged on the first part-body (10*b*), the coil former (40) being arranged partly on the leg of the at least two spaced-apart legs (11*a*) and partly on the other leg (11*b*) of the at least two spaced-apart legs.

5. The electronic component according to claim 3, wherein the industrial filler comprises glass, ceramic or glass-ceramic.

* * * * *